US009445705B2

(12) United States Patent
Joshi

(10) Patent No.: US 9,445,705 B2
(45) Date of Patent: Sep. 20, 2016

(54) FLUID INLET FOR CONTROLLED FILLING OF A DISHWASHER

(75) Inventor: Ameya C. Joshi, Greenville, NC (US)

(73) Assignee: Electrolux Home Products, Inc., Cleveland, OH (US)

( * ) Notice: Subject to any disclaimer, the term of this patent is extended or adjusted under 35 U.S.C. 154(b) by 1399 days.

(21) Appl. No.: 13/240,346

(22) Filed: Sep. 22, 2011

(65) Prior Publication Data

US 2013/0074889 A1 Mar. 28, 2013

(51) Int. Cl.
*A47L 15/42* (2006.01)
*B23P 11/00* (2006.01)

(52) U.S. Cl.
CPC ..... *A47L 15/4217* (2013.01); *Y10T 29/49826* (2015.01)

(58) Field of Classification Search
CPC ..... A47L 15/4217; Y10T 29/49826
See application file for complete search history.

(56) References Cited

U.S. PATENT DOCUMENTS

| | | | | |
|---|---|---|---|---|
| 3,347,250 | A | 10/1967 | Martiniak | |
| 3,356,431 | A | 12/1967 | Martiniak | |
| 3,394,725 | A | 7/1968 | Macoicz | |
| 3,439,688 | A | 4/1969 | Sholtes | |
| 3,508,571 | A | 4/1970 | Dutcher et al. | |
| 3,605,455 | A | 9/1971 | Olthuis | |
| 3,717,168 | A | 2/1973 | Yake | |
| 3,821,961 | A | 7/1974 | Schimke | |
| 4,326,551 | A * | 4/1982 | Voorhees | A47L 15/4291 134/107 |
| 4,657,036 | A | 4/1987 | Yake | |
| 5,251,939 | A | 10/1993 | Jordan | |
| 5,878,603 | A | 3/1999 | Warren, Jr. et al. | |
| 6,349,731 | B1 | 2/2002 | Schaaf et al. | |
| 7,210,315 | B2 | 5/2007 | Castelli et al. | |
| 7,434,587 | B2 | 10/2008 | Jeong | |
| 2002/0050478 | A1 * | 5/2002 | Talbert | C02F 9/005 210/742 |
| 2005/0241675 | A1 | 11/2005 | Jung et al. | |
| 2006/0174916 | A1 | 8/2006 | Hedstrom et al. | |
| 2008/0271792 | A1 | 11/2008 | Jeong | |
| 2009/0277481 | A1 | 11/2009 | Haltmayer et al. | |
| 2009/0277485 | A1 | 11/2009 | Haltmayer et al. | |
| 2010/0186785 | A1 | 7/2010 | Goodyear et al. | |

FOREIGN PATENT DOCUMENTS

| | | |
|---|---|---|
| CN | 201061515 Y | 5/2008 |
| DE | 3 209 500 A1 | 10/1983 |
| DE | 3 643 885 A1 | 6/1988 |

(Continued)

*Primary Examiner* — Michael Barr
*Assistant Examiner* — Benjamin L Osterhout
(74) *Attorney, Agent, or Firm* — Alston & Bird LLP

(57) ABSTRACT

A fluid inlet housing for controlled filling of a dishwasher is provided. For example, a dishwasher comprising a tub for receiving dishware therein, a water conduit, and a fluid inlet housing is provided. The fluid inlet housing is in fluid communication with the tub and the water conduit. Additionally, the fluid inlet housing is configured to direct water from the water conduit into the tub. The fluid inlet housing comprises an inlet for receiving water from the water conduit and an outlet for directing water into the tub. The fluid inlet housing also comprises a first baffle positioned between the inlet and the outlet and configured to divide water flow from the inlet into divergent paths. Moreover, the fluid inlet housing further comprises a second baffle positioned between the first baffle and the outlet and configured to combine the divergent paths of water flow prior to flowing through the outlet.

31 Claims, 7 Drawing Sheets

(56) References Cited

FOREIGN PATENT DOCUMENTS

| | | | |
|---|---|---|---|
| DE | 4 421 251 | A1 | 12/1995 |
| EP | 0 546 434 | A1 | 6/1993 |
| EP | 0 972 529 | A2 | 1/2000 |
| EP | 1 111 118 | A2 | 6/2001 |
| EP | 1 287 779 | A2 | 3/2003 |
| FR | 2 336 031 | | 7/1977 |
| FR | 2 461 480 | | 2/1981 |
| FR | 2 719 208 | A1 | 11/1995 |
| GB | 2 198 052 | A | 6/1988 |
| GB | 2201085 | A | 8/1988 |
| GB | 2 216 400 | A | 10/1989 |
| WO | WO 2005/064068 | A1 | 7/2005 |
| WO | WO 2006/069828 | A1 | 7/2006 |
| WO | WO 2011/152668 | A2 | 12/2011 |

* cited by examiner

FLUID INLET FOR CONTROLLED FILLING OF A DISHWASHER

FIELD

Embodiments of the present invention relate to dishwashing appliances and, more particularly, to systems, methods, and apparatuses for controlled filling of a dishwasher.

BACKGROUND

Dishwashers have become an integral part of everyday household use. Consumers place dishware and other utensils onto racks inside dishwashers for cleaning. Dishwashers typically clean the dishware with wash systems that utilize spray arms and spray jets to propel water onto the dishware to remove food particles and otherwise clean the dishware.

Wash water contained in the dishwasher tub circulates through the wash system to spray on and clean the dishware. The water and food particles or other soil fall from the dishware to the bottom of the tub (e.g., the sump). The food particles or soil drain from the tub and the water is recirculated through the wash system to clean the dishware.

To begin operation of the wash cycle, the dishwasher must be filled with water. During filling of a dishwasher tub, fluid pressure created from the flow of water often causes the water to cascade into the tub. Uncontrolled filling (e.g., cascading water) may generate unnecessary noise as it falls several inches and lands on the bottom of the tub. Thus, there is a need for techniques for providing controlled filling of a dishwasher.

SUMMARY OF THE INVENTION

As such, embodiments of the present invention provide a fluid inlet housing for controlled filling of a dishwasher tub. In some embodiments, the fluid inlet housing is fluidly connected to the water conduit supplying the water and the tub for which filling is desired. Instead of allowing the water supplied to the tub to uncontrollably cascade into the tub however, the fluid inlet housing is configured to encourage water entering the tub to flow along the wall of the tub. Thus, water will gently fall to the bottom of the tub, instead of cascading outwardly and uncontrollably into the tub.

In an exemplary embodiment, the dishwasher comprises a tub for receiving dishware therein, a water conduit, and a fluid inlet housing. The fluid inlet housing is in fluid communication with the tub and the water conduit. Additionally, the fluid inlet housing is configured to direct water from the water conduit into the tub. The fluid inlet housing comprises an inlet for receiving water from the water conduit and an outlet for directing water into the tub. The fluid inlet housing also comprises a first baffle positioned between the inlet and the outlet and configured to divide water flow from the inlet into divergent paths. Moreover, the fluid inlet housing further comprises a second baffle positioned between the first baffle and the outlet and configured to combine the divergent paths of water flow prior to flowing through the outlet.

In some embodiments, the tub comprises a wall, and the fluid inlet housing is configured to direct water entering the tub to flow down the wall of the tub without cascading. For example, in some embodiments, the second baffle is configured to reduce kinetic energy of the water flow by combining the divergent paths of water flow. Additionally or alternatively, the first baffle may be configured to divide the water flow in opposite directions.

In some embodiments, the fluid inlet housing further comprises a third baffle positioned between the second baffle and the outlet, the third baffle being configured to further reduce the velocity of the water flow. Additionally, the fluid inlet housing may further comprise a convergent section positioned between the third baffle and the outlet and configured to direct the water flow toward the outlet.

In some embodiments, the fluid inlet housing comprises first and second sidewalls and a base extending therebetween, wherein the first baffle extends outwardly from the base and between the sidewalls so as to define a pair of flow channels on opposite sides thereof. Additionally, the second baffle may extend outwardly from the base and the second sidewall so as to define a flow channel between the second baffle and the first sidewall. Moreover, the fluid inlet housing may further include a third baffle, wherein the third baffle may extend outwardly from the base and the first sidewall so as to define a flow channel between the third baffle and the second sidewall.

Additionally, the fluid inlet housing may comprise at least one pressure opening defined therethrough configured to regulate pressure in the fluid inlet housing. In some embodiments, the fluid inlet housing may be configured to attach to the outside of the tub. In some embodiments, the inlet of the fluid inlet housing and the outlet of the fluid inlet housing may extend along a respective axis, and the axes may be orthogonal to one another. In some embodiments, the first baffle may define a first height and the second baffle may define a second height, and the second height may be greater than the first height.

In another embodiment, a fluid inlet housing for a dishwasher comprising a tub is provided. The fluid inlet housing is configured to be in fluid communication with the tub and a water conduit. Furthermore, the fluid inlet housing is configured to direct water from the water conduit into the tub. The fluid inlet housing comprises an inlet for receiving water from the water conduit and an outlet for directing water into the tub. The fluid inlet housing further comprises a first baffle positioned between the inlet and the outlet and configured to divide water flow from the inlet into divergent paths. Moreover, the fluid inlet housing further comprises a second baffle positioned between the first baffle and the outlet and configured to combine the divergent paths of water flow prior to flowing through the outlet.

In another embodiment, a method for manufacturing a dishwasher is provided. The method comprising providing a tub and attaching a fluid inlet housing to the tub. The fluid inlet housing is configured to be in fluid communication with the tub and a water conduit. The fluid inlet housing is further configured to direct water from the water conduit into the tub. Additionally, the fluid inlet housing comprises an inlet for receiving water from the water conduit and an outlet for directing water into the tub. The fluid inlet housing also comprises a first baffle positioned between the inlet and the outlet and configured to divide water flow from the inlet into divergent paths. The fluid inlet housing further comprises a second baffle positioned between the first baffle and the outlet and configured to combine the divergent paths of water flow prior to flowing through the outlet. In some embodiments, the fluid inlet housing comprises a third baffle positioned between the second baffle and the outlet, the third baffle being configured to reduce a velocity of the water flow.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION

The present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
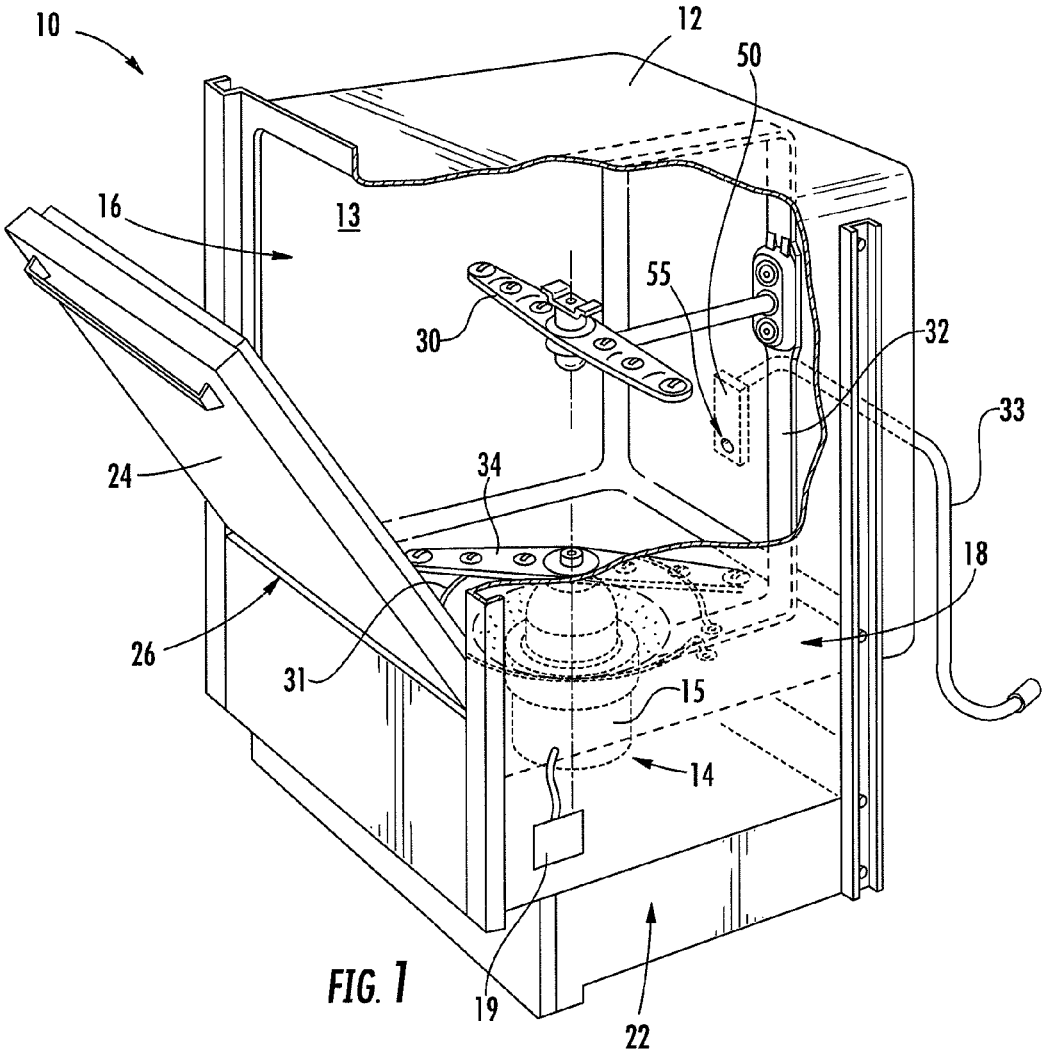
FIG. 1 is a perspective view of a dishwasher, wherein a portion of the dishwasher has been broken away to show internal details, in accordance with some embodiments discussed herein.

FIG. 1 illustrates one example of a dishwasher 10 capable of implementing various embodiments of the present invention. Such a dishwasher 10 typically includes a tub 12 (partly broken away in FIG. 1 to show internal details), having a plurality of walls (e.g., side wall 13, bottom wall 18) for forming an enclosure in which dishes, utensils, and other dishware may be placed for washing. A door 24 may be pivotably engaged (e.g., about a hinge 26) with the tub 12 to selectively permit access to the interior of the tub 12. For example, the door 24 may comprise an open configuration and a closed configuration, such that the door 24 may at least substantially seal the forward access opening 16 of the tub 12 in the closed configuration.

The tub 12 may include a sump 14 in which wash water or rinse water is collected, typically under the influence of gravity. The wash/rinse water may be pumped by a circulation pump 15 to one or more spray arms (e.g., lower spray arm 34, middle spray arm 30) mounted in the interior of the tub 12 for spraying the wash/rinse water, under pressure, onto the dishes, utensils, and other dishware contained therein. For example, the circulation pump 15 may be configured to pump wash water through a supply tube 32 to the middle spray arm 30 for spraying into the tub 12, such as through one or more spray jets located on the middle spray arm 30.

The dishwasher 10 may also comprise a controller 19 that is in communication with one or more of the operational components of the dishwasher 10. For example, the controller 19 may be in communication with the circulation pump 15 and may be configured to selectively operate the circulation pump 15 to pump wash water to at least one spray arm and/or spray jet. In some embodiments, the controller 19 may comprise a processor or other computing means such that operations can be performed in the dishwasher. Additionally or alternatively, the controller 19 may comprise a memory for storage of data such as routines for operation of the dishwasher. In some embodiments, the controller 19 may be housed in the lower end 22 of the dishwasher 10.

The dishwasher 10 may also include at least one dishwasher rack for holding dishes, utensils, dishware, and the like. The dishwasher rack can be positioned within the tub 12 to hold dishware for cleaning, such as through wash water that is sprayed onto the dishware from the spray arms and/or spray jets.

Wash cycles are often employed by a dishwasher to clean dishware contained therein. During a wash cycle, wash water in the tub 12 circulates from the sump 14 through the circulation system and out through spray jets onto the dishware. The water falls back into the sump 14 carrying food particles and other soil that may leave the tub 12 through the drain. Some of the wash water, however, collects in the sump 14 and re-circulates through the circulation system via the circulation pump, thereby reusing much of the water currently inside the tub 12.

To operate the wash cycle, the dishwasher 10 typically fills with water, often from a household water supply. For example, a fluid conduit (e.g., hose 33) may provide water to the tub 12 via an outlet 55, which may comprise an inlet housing 50 in fluid communication with hose 33 and the tub 12.

As such, embodiments of the present invention provide a fluid inlet housing for controlled filling of a dishwasher tub. In some embodiments, the fluid inlet housing is configured to encourage water entering the tub 12 to flow along the wall 13 of the tub 12. Water flowing along the wall 13 of the tub 12 will gently fall to the bottom of the tub, instead of cascading outwardly and uncontrollably from the outlet 35.

Figure 2:
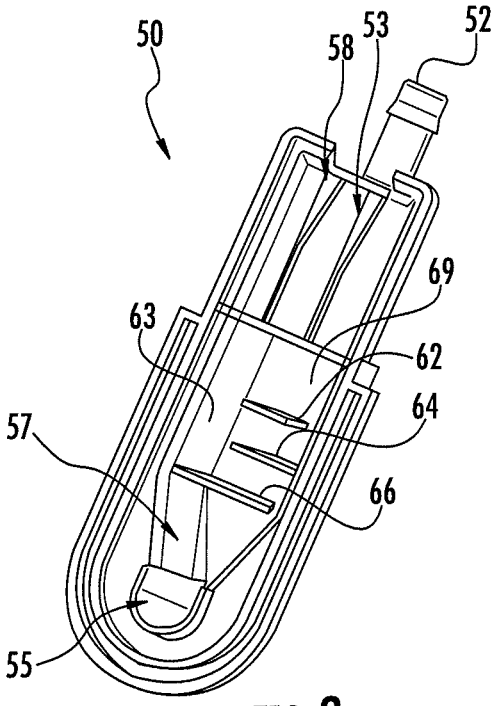
FIG. 2 is a perspective view of an embodiment of a fluid inlet housing configured for controlled filling of a dishwasher, in accordance with some embodiments discussed herein.
Figure 3:
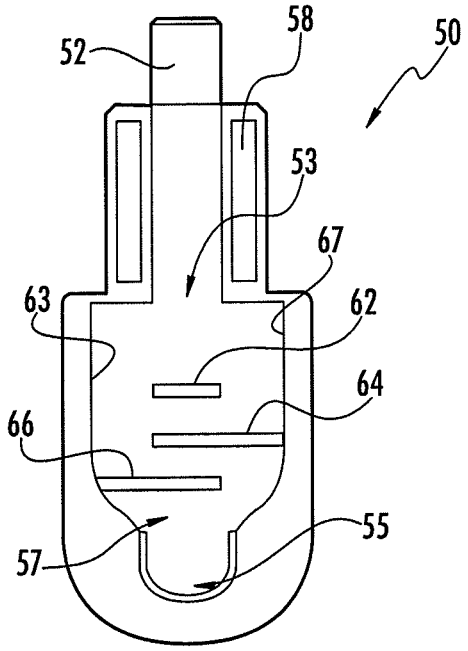
FIG. 3 is a top view of the fluid inlet housing shown in FIG. 2, in accordance with some embodiments discussed herein.
Figure 6:
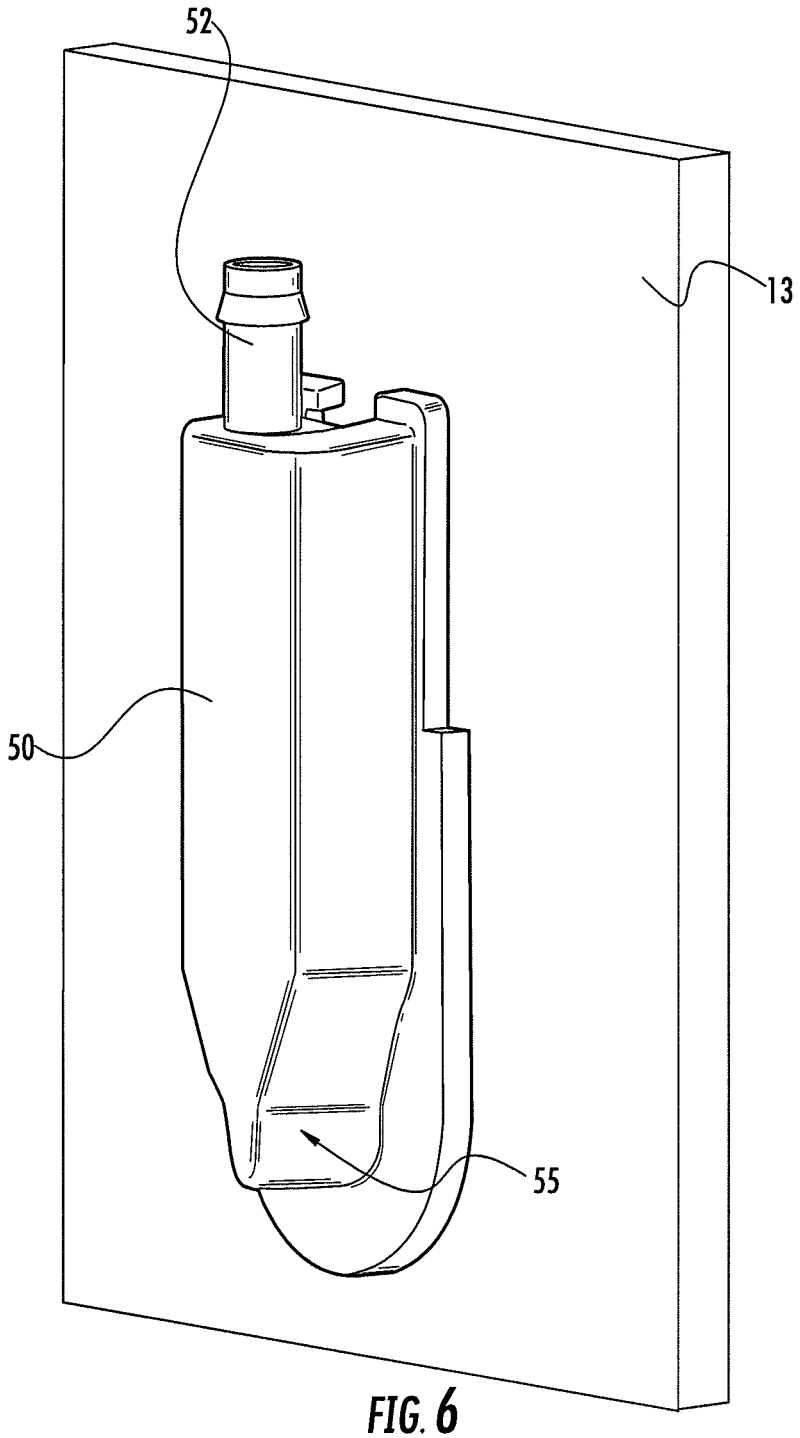
FIG. 6 shows a perspective rear view of a fluid inlet housing attached to the wall of a dishwasher tub, in accordance with some embodiments discussed herein.

FIGS. 2 and 3 illustrate one example embodiment of a fluid inlet housing configured for controlled filling of a dishwasher tub. The fluid inlet housing 50 may be in fluid communication with the tub 12 and a water conduit (e.g., hose 33) and be configured to direct water from the water conduit 33 into the tub 12. In some embodiments, with reference to FIG. 6, the fluid inlet housing 50 may be attached to the outside of the tub 12.

The fluid inlet housing 50 may comprise an inlet 52 and an outlet 55. The inlet 52 is configured to receive water from the water conduit. The inlet 52 may be fluidly connected to a water conduit and configured to provide water from the water conduit to the housing 50. The outlet 55 is configured to direct water into the tub. In this regard, the outlet 55 may be in fluid communication with the tub 12 and configured to provide water to the tub 12. For example, the outlet 55 may protrude through, or otherwise engage, the wall 13 of the tub 12. In some embodiments, the inlet 52 is defined by an axis that is different than the axis defining the outlet 55. For example, the inlet 52 may define an axis that is orthogonal to the axis of the outlet 55.

The fluid inlet housing 50 may define a channel 53 extending between the inlet 52 and the outlet 55. In one embodiment, the channel 53 is defined by first and second sidewalls 63, 67 and a base 69 extending therebetween. The channel 53 defines a path for water to flow from the inlet 52 to the outlet 55. In some embodiments, the configuration and design of the fluid inlet housing 50 and the channel 53 create a water flow path that controls the velocity and/or flow of the water to cause the water entering the tub to flow down the wall of the tub without cascading. As such, controlled filling of the dishwasher may be obtained.

In one embodiment, the inlet housing 50 comprises a plurality of baffles. The fluid inlet housing 50 may comprise a first baffle 62 positioned between the inlet 52 and the outlet 55 and configured to divide water flow from the inlet 52 into divergent paths. For example, in some embodiments, the first baffle 62 may extend outwardly from the base 69 and between the sidewalls 63, 67 so as to define a pair of flow channels on opposite sides thereof. In such a manner, as water flows through the channel 53 and contacts the first baffle 62, the water separates into different paths. This process slows the velocity of the water flowing through the channel 53. In some embodiments, the first baffle 62 may be configured to divide the water flow in opposite directions.

The fluid inlet housing 50 may also comprise a second baffle 64 positioned between the first baffle 62 and the outlet 55 and configured to combine the divergent paths of water flow prior to flowing through the outlet 55. For example, in some embodiments, the second baffle 64 may extend outwardly from the base 69 and the second sidewall 67 so as to define a flow channel between the second baffle 64 and the first sidewall 63. In such a manner, the water flowing from separate paths (as created by the first baffle 62) will contact the second baffle 64 and re-combine into one path, thereby reducing the kinetic energy of the water flow.

In some embodiments, the fluid inlet housing 50 may also comprise a third baffle 66 positioned between the second baffle 64 and the outlet 55 and configured to further reduce the velocity of the water flow. For example, in some embodiments, the third baffle 66 may extend outwardly from the base 69 and the first sidewall 63 so as to define a flow channel between the third baffle 66 and the second sidewall 67. In such a manner, water flowing from the second baffle 64 will contact the third baffle 66 and be diverted around the third baffle 66, thereby slowing down further.

In some embodiments, the fluid inlet housing 50 may also comprise a convergent section 57 defined between the third baffle 66 and the outlet 55 and configured to direct the water flow towards the outlet 55. For example, the walls of the convergent section 57 may slope toward the outlet 55 thereby narrowing the channel 53. In such a manner, the water flow may converge, being directed toward the outlet 55.

Though the depicted embodiment illustrates a fluid inlet housing 50 with a first baffle 62, second baffle 64, third baffle 66, and convergent section 57, embodiments of the present invention may provide a fluid inlet housing configured to cause controlled filling with any combination of baffles, convergent, and/or divergent sections as described herein. For example, in some embodiments, the fluid inlet housing may comprise an inlet, an outlet, a first baffle, and a second baffle. As such, embodiments of the present invention provide a fluid inlet housing configured with features (e.g., baffles, convergent sections, and/or divergent sections) for manipulating water flow through the housing. In particular, with reduced velocity, the water will be directed out of the outlet of the fluid inlet housing and into the tub in a controlled manner (e.g., run down the wall of the tub instead of cascade from the outlet).

Figure 4:
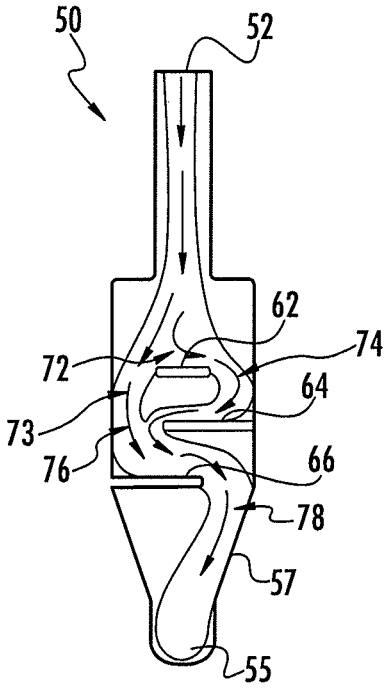
FIG. 4 illustrates the water flow path inside the fluid inlet housing shown in FIG. 2, in accordance with some embodiments discussed herein.

FIG. 4 illustrates the water flow path for water passing through the fluid inlet housing 50 shown in FIGS. 2 and 3. In the depicted embodiment, water provided by the water conduit will flow through the inlet 52. Water will contact the first baffle 62 and divide into different flow paths (e.g., flow paths 73 and 74, respectively) around the first baffle 62. This division reduces the velocity of the water flowing through the fluid inlet housing 50.

With the water divided into different flow paths 73, 74, the water running down flow path 74 will contact the second baffle 64 and be diverted around it. This water will be forced toward flow path 73, causing the water to re-combine at point 76, further reducing the velocity of the water. Then, the re-combined water will contact and be diverted around the third baffle 66, which causes the water to slow further. The water is directed along path 78 by the convergent section 57 towards the outlet 55. Thus, the water flows at a slower, controlled rate out of the outlet 55 and into the tub 12, instead of cascading into the tub 12 in an uncontrolled manner. In some embodiments, the fluid inlet housing 50 controls velocity of the water flow through the channel independent of the degree of the velocity of the water entering the channel. Thus, an incoming velocity that is higher than required or specified can be controlled using the fluid inlet housing. For example, some testing has shown that the fluid inlet housing 50 may cause water to enter the tub safely even when water flows into the fluid inlet housing 50 at velocity exceeding 2 times the specified water flow velocity. In fact, testing with the fluid inlet housing 50 depicted in FIG. 2 has been shown to slow water flow that enters the inlet 52 at approximately 1.28 m/s to approximately 0.79 m/s when exiting the outlet 55.

Figure 5:
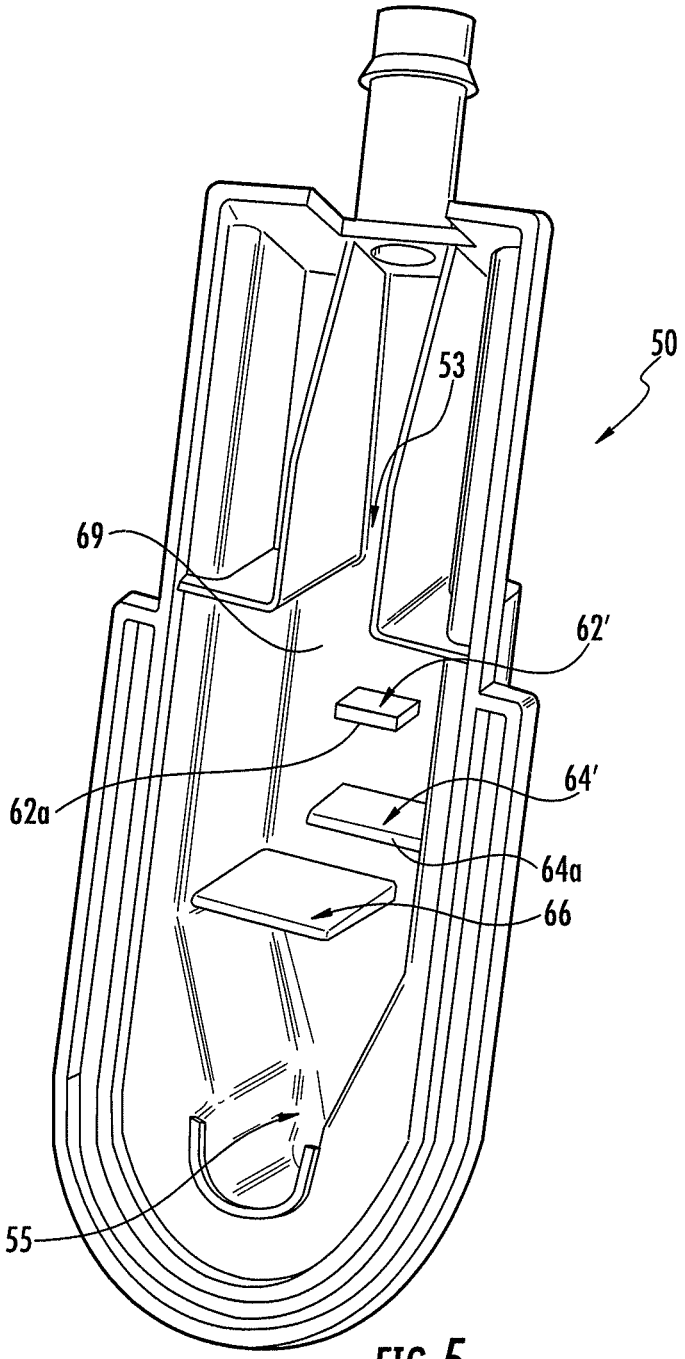
FIG. 5 is a perspective view of another embodiment of the fluid inlet housing shown in FIG. 2, in accordance with some embodiments discussed herein.
Figure 5A:
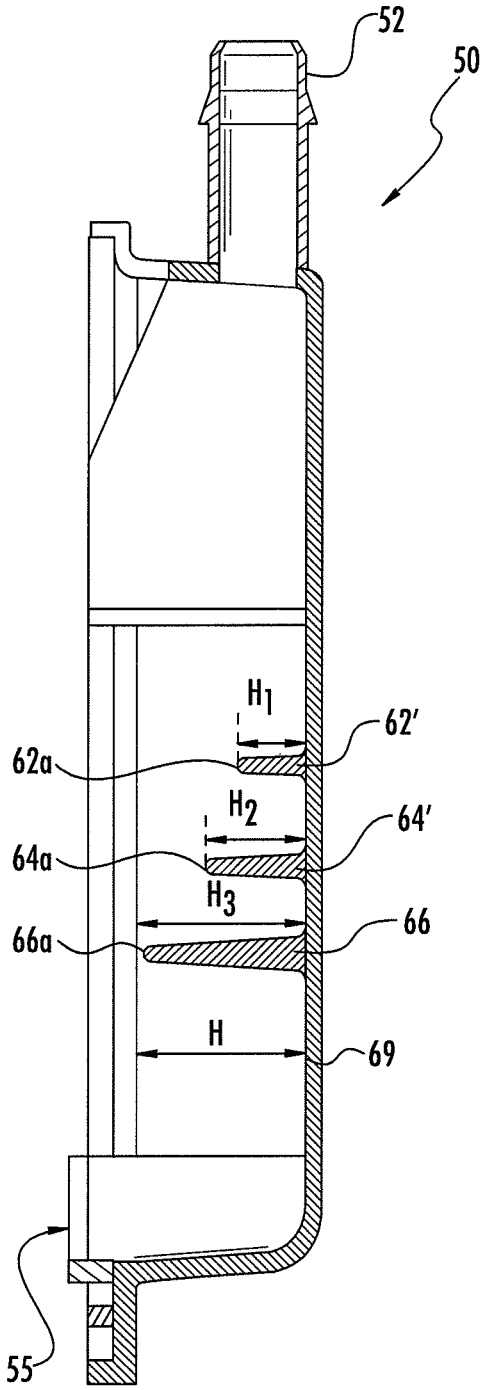
FIG. 5A shows a cross-sectional view of the fluid inlet housing shown in FIG. 5, in accordance with some embodiments discussed herein.

FIGS. 5 and 5A illustrate another embodiment of the fluid inlet housing 50 shown in FIGS. 2 and 3. In the depicted embodiment, the channel 53 of the fluid inlet housing 50 comprises a height (H) measured outwardly from the base 69. In some embodiments, the height (H) extends between the base 69 and the cover (not shown). Additionally or alternatively, the height (H) may be defined between the base 69 and the outside of the dishwasher tub wall 13 (see e.g., FIG. 6). Similar to the fluid inlet housing 50 described above with respect to FIGS. 2 and 3, a first baffle 62' may be positioned between the inlet 52 and the outlet 55 and configured to divide water flow from the inlet 52 into divergent paths. In such a manner, water flowing through the channel 53 will contact the first baffle 62' and separate into different paths, slowing the velocity of the water. Additionally, however, the first baffle 62' in the depicted fluid inlet housing 50 has a height ($H_1$) that is less than height (H). Thus, the first baffle may not extend fully to the cover and/or tub wall 13. In other words, the first baffle 62' may extend outwardly from the base 69, but not extend fully to the cover and/or tub wall 13, thereby defining a flow channel between the top edge **62*a* of the first baffle 62' and the cover and/or tub wall 13. As such, water may flow over the top edge 62*a* of the first baffle 62'** creating a waterfall effect inside the fluid inlet housing, which further slows the water flow.

Also similar to the fluid inlet housing 50 described above with respect to FIGS. 2 and 3, a second baffle 64' may be positioned between the first baffle 62' and the outlet 55 and configured to combine the divergent paths of water flow prior to flowing through the outlet 55. In such a manner, water flowing from separate paths (as created by the first baffle 62') will contact the second baffle 64' and re-combine into one path, thereby reducing the kinetic energy of the water flow. Additionally, however, the second baffle 64' in the depicted fluid inlet housing 50 defines a height ($H_2$) that is also less than height (H). As such, the second baffle may not extend fully to the cover and/or tub wall 13. In other words, the second baffle 64' may extend outwardly from the base 69, but not extend fully to the cover and/or tub wall 13, thereby defining a flow channel between the top edge 64*a* of the second baffle 64' and the cover and/or tub wall 13. As such, water may flow over the top edge 64*a* of the second baffle 64' creating a waterfall effect inside the fluid inlet housing, which further slows the water flow.

In some embodiments, a third baffle 66 may be positioned between the second baffle 64 and the outlet 55 and configured to further reduce the velocity of the water flow. In such a manner, water flowing from the second baffle 64 will contact the third baffle 66 and be diverted around the third baffle 66, thereby slowing down further. Additionally, however, the third baffle 66' in the depicted fluid inlet housing 50 defines a height ($H_3$) that is also less than height (H) and does not extend fully to the cover and/or tub wall 13. In other words, the third baffle 66' may extend outwardly from the base 69, but not extend fully to the cover and/or tub wall 13, thereby defining a flow channel between the top edge 66*a* of the third baffle 66' and the cover and/or tub wall 13. As such, some water may flow over the top edge 66*a* of the third baffle 66' creating a waterfall effect inside the fluid inlet housing, which further slows the water flow. In some embodiments, the third baffle may define a height ($H_3$) that is substantially equal to height (H) or, in some embodiments, extend up to the cover and/or tub wall 13.

As noted above, in some embodiments, the fluid inlet housing 50 may comprise a first baffle 62' and a second baffle 64', each with heights that do not extend to the top of the channel 53. In the depicted embodiment, the height ($H_2$) of the second baffle 64' is greater than the height ($H_1$) of the first baffle 62', thereby creating a stepped height wherein the flow path between the top edge 62*a* of the first baffle 62' and the top of the channel 53 is greater than the flow path between the top edge 64*a* of the second baffle 64' and the top of the channel 53. Likewise, the height ($H_3$) of the third baffle 66' is greater than the height of the second baffle 64', which blocks at least a portion of the water flow through the flow path between the top edge 64*a* of the second baffle 64' and the top of the channel 53. This stepped design creates a waterfall effect that further breaks apart the flow of water through the channel 53, further slowing the velocity of water flow. In fact, testing with the fluid inlet housing 50 depicted in FIG. 5 has been shown to slow water flow that enters the inlet 52 at approximately 1.28 m/s to approximately 0.5 m/s when exiting the outlet 55. In one embodiment, the first baffle 62' extends to a height of approximately 6 mm from the base 69, the second baffle 64' extends to a height of approximately 10 mm from the base 69, and the second baffle 66' extends to a height of approximately 14 mm from the base 69.

In some embodiments, with reference to FIGS. 2 and 3, the fluid inlet housing 50 may comprise at least one pressure opening 58 defined therethrough, thereby facilitating communication with air outside of the fluid inlet housing 50. The pressure opening 58 allows air trapped inside the fluid inlet housing 50 to escape, thereby maintaining an even flow of the water inside the housing 50. As such, in some embodiments, the pressure opening 58 is configured to regulate pressure inside the fluid inlet housing 50. For example, with reference to FIG. 2, pressure openings 58 may be defined within the fluid inlet housing 50 on at least one side of the channel 53 defined laterally outward of the sidewalls such that water entering the inlet does not pass through the pressure opening 58. In the depicted embodiment, the pressure openings 58 are defined on both sides of the channel 53 and positioned near the inlet 52. The pressure openings 58 allow air to enter into the fluid inlet housing 50 to regulate the pressure inside the fluid inlet housing 50. Such pressure balancing may prevent sucking of water out of the tub when there is a sudden pressure drop in the water inlet line.

Figure 7:
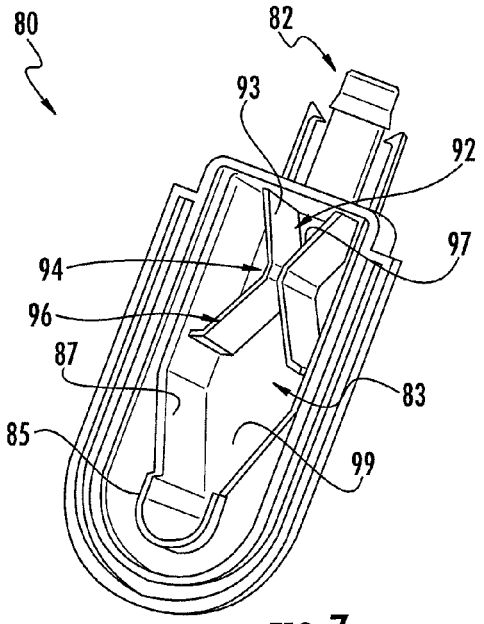
FIG. 7 is a perspective view of another embodiment of a fluid inlet housing configured for controlled filling of a dishwasher, in accordance with some embodiments discussed herein.
Figure 8:
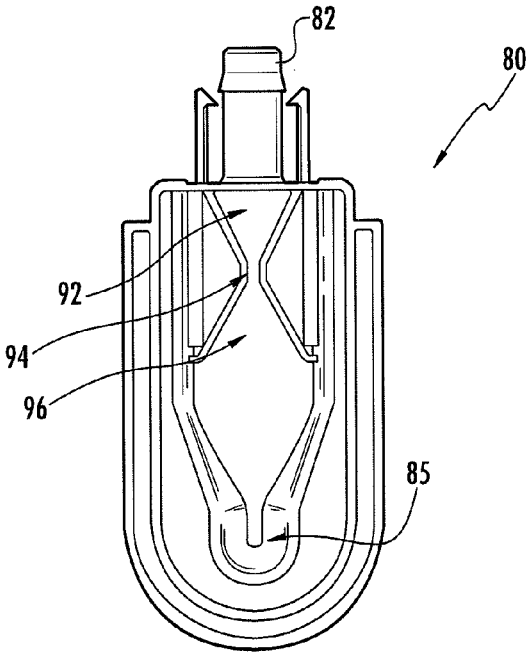
FIG. 8 is top view of the fluid inlet housing shown in FIG. 7, in accordance with some embodiments discussed herein.
Figure 9:
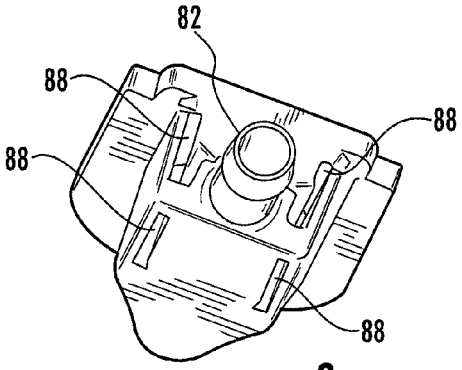
FIG. 9 is perspective rear view of the fluid inlet housing shown in FIG. 7, in accordance with some embodiments discussed herein.

FIGS. 7, 8, and 9 illustrate another exemplary embodiment of a fluid inlet housing 80 configured for controlled filling of a dishwasher tub. Similar to fluid inlet housing 50, the fluid inlet housing 80 may be in fluid communication with the tub 12 and a water conduit (e.g., hose 33). Additionally, the fluid inlet housing 80 may be configured to direct water from the water conduit 33 into the tub 12.

The fluid inlet housing 80 may comprise an inlet 82 and an outlet 85. The inlet 82 is configured to receive water from the water conduit. The inlet 82 may be fluidly connected to a water conduit and configured to direct water from the water conduit to the housing 80. The outlet 85 is configured to direct water into the tub. The outlet 85 may be in fluid communication with the tub 12 and configured to direct water to the tub 12. In some embodiments, the inlet 82 is defined by an axis that is different than the axis defining the outlet 85. For example, the inlet 82 may define an axis that is orthogonal to the axis of the outlet 85.

The fluid inlet housing 80 may define a channel 83 extending between the inlet 82 and the outlet 85. The channel 83 is defined by first and second sidewalls 93, 97 and a base 99 extending therebetween, wherein the sidewalls extend outwardly from the base. The channel 83 defines a path for water to flow from the inlet 82 to the outlet 85. In some embodiments, the configuration and design of the fluid inlet housing 80 and the channel create a water flow path that manipulates the velocity and/or flow of the water to cause the water entering the tub to flow down the wall of the tub without cascading. As such, controlled filling of the dishwasher may be obtained.

In the depicted embodiment, the fluid inlet housing 80 comprises at least one convergent section 92 between the inlet 82 and a throat section 94. The convergent section 92 is configured to increase the pressure and the kinetic energy of the water flow entering the channel 83 through the inlet 82. The convergent section may be formed by the inward slope of the first sidewall 93 and the second sidewall 97 towards each other.

In some embodiments, the fluid inlet housing 80 may also comprise a throat section 94. The throat section 94 is configured to constrict the flow of the water to increase the velocity of the water flow. In some embodiments, the water flow may reach at least close to the choked flow condition in the throat section 94.

The fluid inlet housing 80 may further comprise a divergent section 96 between the throat section 94 and the outlet 85. The divergent section 96 is configured to decrease the kinetic energy of the water flow exiting the throat section 94, thereby slowing the velocity of the water prior to reaching the outlet 85. The divergent section 96 may be formed by the outward slope of the first sidewall 93 and the second sidewall 97 away from each other.

In some embodiments, similar to fluid inlet housing 50, fluid inlet housing 80 may also comprise a convergent section 87 designed to direct/funnel the water toward the outlet 85. For example, the walls of the convergent section 87 may slope toward the outlet 85 thereby narrowing the channel 83. In such a manner, the water flow may converge, thereby being directed toward the outlet 85.

As such, the depicted embodiment of the fluid inlet housing 80 defines a water flow path that causes water to fill the tub in a controlled manner. For example, water provided by the water conduit will flow through the inlet 82. The velocity of the water will increase through the convergent section 92 and move into the throat section 94. Then, as the water passes into the divergent section 96 the flow expands due to increase in available volume, the velocity of the water will decrease. This phenomenon is referred to as the Venturi effect. The water will be directed to the outlet 85 through the convergent section 87. Finally, the water will exit the outlet 85 and flow into the tub 12 at a slower, controlled rate, instead of cascading into the tub 12 in an uncontrolled manner.

Though the depicted embodiment illustrates a fluid inlet housing 80 with a convergent section 92, throat 94, divergent section 96, and convergent section 87, embodiments of the present invention may provide a fluid inlet housing configured to cause controlled filling with any combination or number of convergent, throat, and/or divergent sections as described herein. For example, in some embodiments, the fluid inlet housing may comprise two sets of a convergent section, throat, and divergent section combination. As such, embodiments of the present invention provide a fluid inlet housing configured with features (e.g., convergent sections, divergent sections, and/or throat) for manipulating water flow through the housing. For example, with reduced velocity, the water will be directed through the outlet of the fluid inlet housing and into the tub in a controlled manner (e.g., run down the wall of the tub instead of cascade from the outlet).

In some embodiments, with reference to FIG. 9, the fluid inlet housing 80 may comprise at least one pressure opening 88. The pressure opening 88 allows air trapped inside the fluid inlet housing 80 to escape, thereby maintaining an even flow of the water inside the housing 80. As such, in some embodiments, the pressure opening 88 is configured to regulate pressure inside the fluid inlet housing 80 and the tub 12. For example, with reference to FIG. 9, pressure openings 88 may be defined within the fluid inlet housing 80 on at least one side of the channel 83. In the depicted embodiment, the pressure openings 88 are defined laterally outward of the sidewalls 93, 97 and positioned near the inlet 82. In some embodiments, the pressure openings 88 may be defined laterally outward of the sidewalls 93, 97 and through the base 99 of the fluid inlet housing 80. The pressure openings 88 allow air to enter into the fluid inlet housing 80 to regulate the pressure inside the fluid inlet housing 80. Such pressure balancing may prevent sucking of water out of the tub when there is a sudden pressure drop in the water inlet line.

Embodiments of the present invention may be utilized for operation of a dishwasher to provide controlled filling of the tub of the dishwasher. For example, a method may comprise providing water to a tub through a fluid inlet housing according to any of the embodiments described herein. Such water will enter the tub in a controlled manner (e.g., running along the wall of the tub), instead of cascading into the tub.

Additionally, embodiments of the present invention provide a method of manufacturing a dishwasher for providing controlled filling of a dishwasher. The method of manufacturing may comprise assembling a dishwasher tub with any of the embodiments of the fluid inlet housing described herein. Such a dishwasher will provide for controlled filling of the tub through the fluid inlet housing. In one exemplary embodiment, the method includes providing a tub and attaching a fluid inlet housing to the tub.

Exemplary advantages of some embodiments of the present invention include controlled filling of the dishwasher tub. Water entering the tub will cause less noise as it does not drop and hit the bottom of the tub and, instead, runs down the wall of the tub. Additionally, some embodiments employ pressure balancing (e.g., with pressure openings 58 and 88), which prevents sucking of water out of the tub when there is a sudden pressure drop in the water inlet line.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included herein. Although specific terms are employed herein, they are used in a generic and descriptive sense only and not for purposes of limitation.

The invention claimed is:

1. A dishwasher comprising:

a tub for receiving dishware therein;

a water conduit for providing water from an external source; and a fluid inlet housing directly connected to and in fluid communication with the tub and the water conduit, the fluid inlet housing configured to direct the water from the water conduit into the tub, the fluid inlet housing comprising:

an inlet for receiving the water from the water conduit;

an outlet for directing the water into the tub, wherein the fluid inlet housing defines a base and two opposing sidewalls extending between the inlet and the outlet;

a first baffle extending directly from the base and positioned between the inlet and the outlet and configured to divide flow of the water from the inlet into divergent paths; and a second baffle extending directly from the base and positioned between the first baffle and the outlet and configured to combine the divergent paths of the flow of the water prior to the outlet.

2. The dishwasher according to claim 1, wherein the tub comprises a wall, and wherein the fluid inlet housing is configured to direct the water entering the tub to flow down the wall of the tub without cascading.

3. The dishwasher according to claim 1, wherein the second baffle is configured to reduce kinetic energy of the flow of the water by combining the divergent paths.

4. The dishwasher according to claim 1, wherein the fluid inlet housing further comprises a third baffle positioned between the second baffle and the outlet, the third baffle being configured to reduce a velocity of the flow of the water.

5. The dishwasher according to claim 4, wherein the fluid inlet housing further comprises a convergent section positioned between the third baffle and the outlet and configured to direct the flow of the water toward the outlet.

6. The dishwasher according to claim 1, wherein the first baffle is further configured to divide the flow of the water in opposite directions.

7. The dishwasher according to claim 1, wherein the fluid inlet housing comprises at least one pressure opening defined therethrough configured to regulate pressure in the fluid inlet housing.

8. The dishwasher according to claim 1, wherein the fluid inlet housing is configured to attach to the outside of the tub.

9. The dishwasher according to claim 1, wherein the first baffle extends outwardly from the base and between the sidewalls so as to define a pair of flow channels on opposite sides thereof.

10. The dishwasher according to claim 9, wherein the second baffle extends outwardly from the base and the second sidewall so as to define a flow channel between the second baffle and the first sidewall.

11. The dishwasher according to claim 10, wherein the fluid inlet housing further comprising a third baffle extending outwardly from the base and the first sidewall so as to define a flow channel between the third baffle and the second sidewall.

12. The dishwasher according to claim 1, wherein each of the inlet and the outlet extends along a respective axis, and wherein the axes are orthogonal to one another.

13. The dishwasher according to claim 1, wherein the first baffle defines a first height, wherein the second baffle defines a second height, and wherein the second height is greater than the first height, wherein the fluid inlet housing defines a top surface and a base, and wherein the first baffle defines a top edge and extends from the base so as to define a flow channel between the top edge and the top surface of the fluid inlet housing.

14. The dishwasher according to claim 1, wherein the fluid inlet housing is attached to a sidewall of the tub, wherein the first baffle extends from the base of the fluid inlet housing toward the sidewall of the tub, and wherein the second baffle extends from the base of the fluid inlet housing toward the sidewall of the tub.

15. A fluid inlet housing for a dishwasher, the dishwasher comprising a tub, the fluid inlet housing directly connected to and configured to be in fluid communication with the tub and a water conduit, wherein the water conduit is configured to provide water from an external source, the fluid inlet housing configured to direct the water from the water conduit into the tub, the fluid inlet housing comprising:

an inlet for receiving the water from the water conduit;

an outlet for directing the water into the tub, wherein the fluid inlet housing defines a base and two opposing sidewalls extending between the inlet and the outlet;

a first baffle extending directly from the base and positioned between the inlet and the outlet and configured to divide flow of the water from the inlet into divergent paths; and a second baffle extending directly from the base and positioned between the first baffle and the outlet and configured to combine the divergent paths of the flow of the water prior to the outlet.

16. The fluid inlet housing according to claim 15, wherein the second baffle is configured to reduce kinetic energy of the flow of the water by combining the divergent paths.

17. The fluid inlet housing according to claim 15 further comprising a third baffle positioned between the second baffle and the outlet, the third baffle being configured to reduce a velocity of the flow of the water.

18. The fluid inlet housing according to claim 17 further comprising a convergent section positioned between the third baffle and the outlet and configured to direct the flow of the water toward the outlet.

19. The fluid inlet housing according to claim 15, wherein the first baffle is further configured to divide the flow of the water in opposite directions.

20. The fluid inlet housing according to claim 15 further comprising at least one pressure opening configured to regulate pressure in the fluid inlet housing.

21. The fluid inlet housing according to claim 15 wherein the first baffle extends outwardly from the base and between the sidewalls so as to define a pair of flow channels on opposite sides thereof.

22. The fluid inlet housing according to claim 21, wherein the second baffle extends outwardly from the base and the second sidewall so as to define a flow channel between the second baffle and the first sidewall.

23. The fluid inlet housing according to claim 22 further comprising a third baffle extending outwardly from the base and the first sidewall so as to define a flow channel between the third baffle and the second sidewall.

24. The fluid inlet housing according to claim 15, wherein each of the inlet and the outlet extends along a respective axis, and wherein the axes are orthogonal to one another.

25. The fluid inlet housing according to claim 15, wherein the first baffle defines a first height, wherein the second baffle defines a second height, and wherein the second height is greater than the first height, wherein the fluid inlet housing defines a top surface and a base, and wherein the first baffle defines a top edge and extends from the base so as to define a flow channel between the top edge and the top surface of the fluid inlet housing.

26. The fluid inlet housing according to claim 15, wherein the fluid inlet housing is attached to a sidewall of the tub, wherein the first baffle extends from the base of the fluid inlet housing toward the sidewall of the tub, and wherein the second baffle extends from the base of the fluid inlet housing toward the sidewall of the tub.

27. A method of assembling a dishwasher comprising:

providing a tub; and attaching a fluid inlet housing to the tub, the fluid inlet housing directly connected to and configured to be in fluid communication with the tub and a water conduit, wherein the water conduit is configured to provide water from an external source, wherein the fluid inlet housing is configured to direct the water from the water conduit into the tub, the fluid inlet housing comprising:

an inlet for receiving the water from the water conduit;

an outlet for directing the water into the tub, wherein the fluid inlet housing defines a base and two opposing sidewalls extending between the inlet and the outlet;

a first baffle extending directly from the base and positioned between the inlet and the outlet and configured to divide flow of the water from the inlet into divergent paths; and a second baffle extending directly from the base and positioned between the first baffle and the outlet and configured to combine the divergent paths of the flow of the water prior to the outlet.

28. The dishwasher according to claim 1, wherein the first baffle is positioned to extend across the flow of water to divide the flow of the water into the divergent paths.

29. The fluid inlet housing according to claim 15, wherein the first baffle is positioned to extend across the flow of water to divide the flow of the water into the divergent paths.

30. The method according to claim 27, wherein the first baffle is positioned to extend across the flow of water to divide the flow of the water into the divergent paths.

31. The method according to claim 27, wherein the fluid inlet housing is attached to a sidewall of the tub, wherein the first baffle extends from the base of the fluid inlet housing toward the sidewall of the tub, and wherein the second baffle extends from the base of the fluid inlet housing toward the sidewall of the tub.

* * * * *